United States Patent [19]

van der Meulen

[11] Patent Number: 4,717,037

[45] Date of Patent: Jan. 5, 1988

[54] BEVERAGE CAN DRINKING ATTACHMENT

[76] Inventor: Leendert van der Meulen, 1804 Bayshore Raod, S.W., Calgary, Alberta, Canada, T2V 3M1

[21] Appl. No.: 918,079

[22] Filed: Oct. 14, 1986

Related U.S. Application Data

[63] Continuation-in-part of Ser. No. 834,771, Feb. 28, 1986.

[30] Foreign Application Priority Data

Mar. 1, 1985 [NL] Netherlands ..... 8500574

[51] Int. Cl.[4] ..... B65D 25/48

[52] U.S. Cl. ..... 220/90.6; 220/90.4; 222/531

[58] Field of Search ..... 220/90.4, 90.6; 222/531, 548, 567, 570

[56] References Cited

U.S. PATENT DOCUMENTS

| | | | |
|---|---|---|---|
| 2,075,721 | 3/1937 | Hommel | 220/90.6 |
| 2,725,732 | 12/1955 | Somoza | 220/90.6 |
| 2,729,956 | 1/1956 | Gilbert | 220/90.4 |
| 2,782,614 | 2/1957 | Currie | 220/90.6 |
| 3,085,710 | 4/1963 | McIlroy . | |
| 3,103,297 | 9/1963 | Taft . | |
| 3,185,341 | 5/1965 | Barbour | 220/90.6 |
| 3,372,832 | 3/1968 | Yeater et al. | 222/570 X |
| 3,907,172 | 9/1975 | Curtis . | |
| 3,972,453 | 8/1976 | Kapples | 222/570 X |
| 4,054,205 | 10/1977 | Blow, Jr. et al. . | |
| 4,098,439 | 7/1978 | Blow, Jr. et al. | 220/90.6 |
| 4,099,642 | 7/1978 | Nergard . | |
| 4,322,014 | 3/1982 | Philip . | |
| 4,403,709 | 9/1983 | Meins et al. . | |
| 4,412,629 | 11/1983 | Dart et al. | 220/90.4 |
| 4,415,097 | 11/1983 | Meins . | |
| 4,428,498 | 1/1984 | Obey . | |
| 4,586,625 | 5/1986 | Garrett | 220/90.4 X |
| 4,634,014 | 1/1987 | Carr | 220/90.4 X |

FOREIGN PATENT DOCUMENTS

| | | |
|---|---|---|
| 35480 | 5/1983 | Australia . |
| 3331741 | 3/1985 | Fed. Rep. of Germany . |
| 8302980 | 3/1985 | Netherlands . |

*Primary Examiner*—Steven M. Pollard

*Attorney, Agent, or Firm*—Schwartz, Jeffery, Schwaab, Mack, Blumenthal & Evans

[57] ABSTRACT

A beverage can attachment having a substantially cylindrical body with clamping means for obtaining a liquid tight connection between the cap and a beverage can, an inner disk having means for engaging the upper rim of the can, a disk aperture which is alignable with the can lid opening, and disk means for receiving a can lid opening device. The attachment can be mounted to the top of a beverage can which has the opening device remaining attached to the can top after the can is opened.

24 Claims, 10 Drawing Figures

FIG. 1.
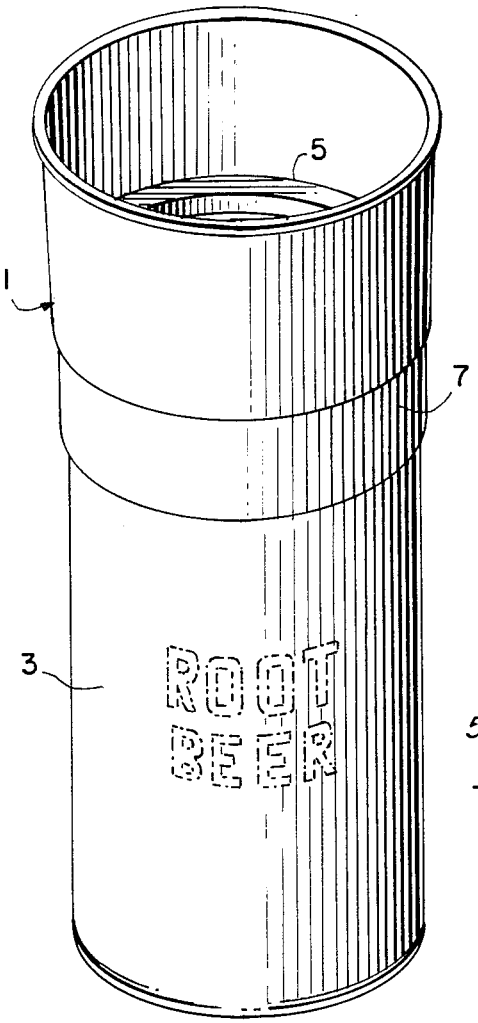
FIG. 2.
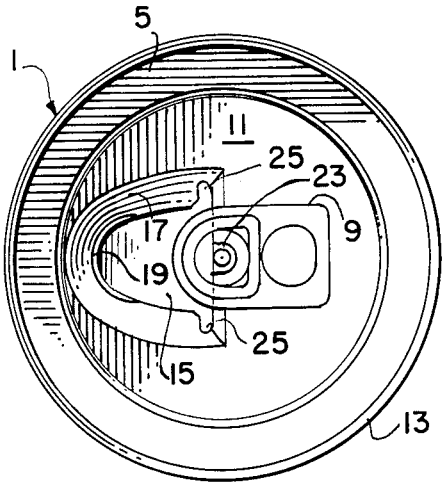
FIG. 3.
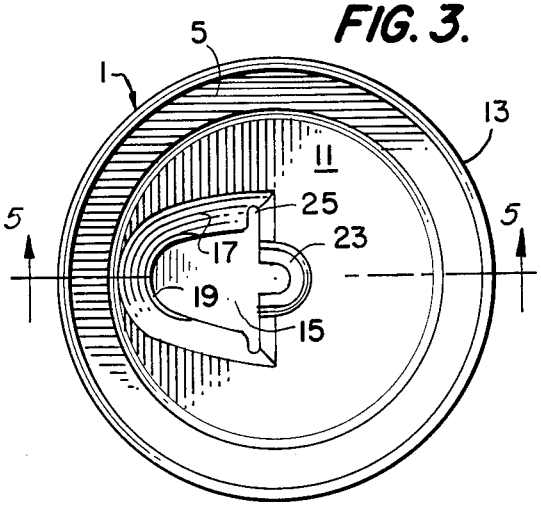
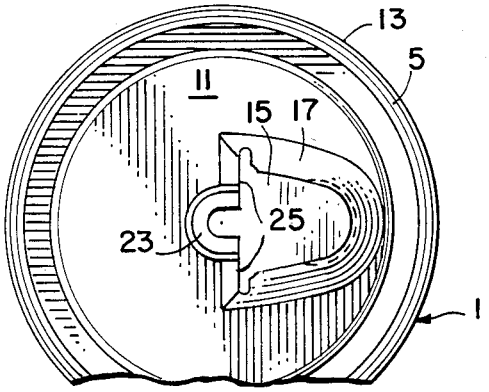
FIG. 4.

FIG. 8.
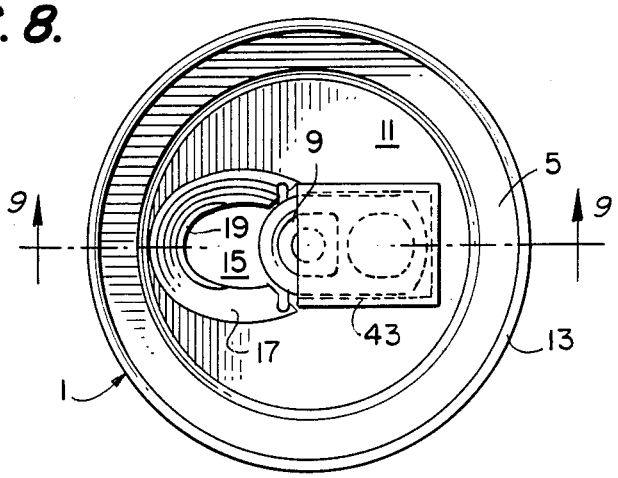
FIG. 9.
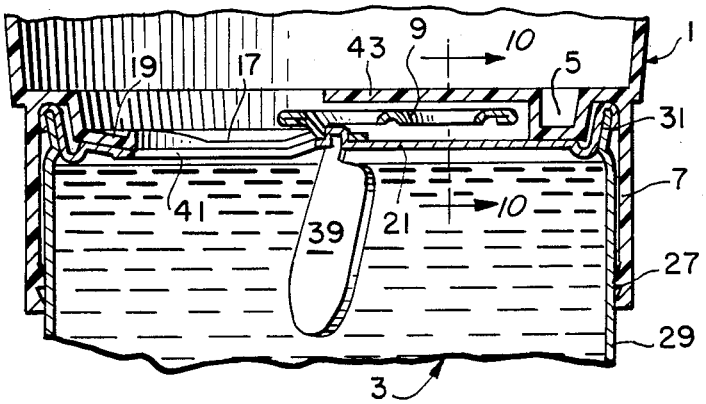
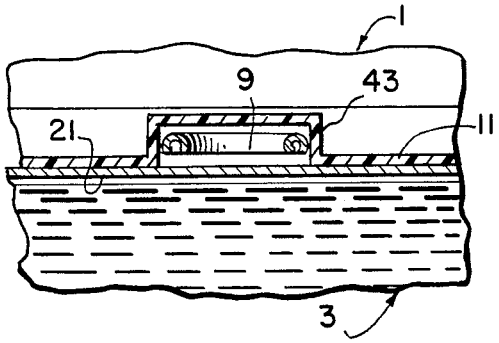
FIG. 10.

BEVERAGE CAN DRINKING ATTACHMENT

This application is a continuation-in-part of U.S. application Ser. No. 834,771, filed Feb. 28, 1986.

BACKGROUND OF THE INVENTION

1. Field of the Invention

This invention relates to a beverage can attachment. In particular this invention relates to a beverage can drinking attachment which can be mounted on a beverage can with the lid tab remaining attached to the can top.

2. Description of the Related Art

Attachable lid covers and drinking spouts designed for beverage cans are known in the art. Changes in drinking spout design have generally paralleled changes in beverage can design. Initially, beverage cans required a separate opener for puncturing the lid of the can. These can openers made a triangular opening in the can lid. Drinking spouts designed for this type of can are of the type disclosed in U.S. Pat. No. 2,075,721 to Hommel, which shows a collar having a hollow circular body which is placed on the can rim.

The desire to provide consumers with a beverage that can be opened conveniently resulted in the development of pull-tab or flip-top type cans. According to this design a ring is attached to a portion of the can lid. The can is opened by completely detaching the ring from the can thus tearing away a portion of the can lid. Drinking spouts designed for this type of can are of the type disclosed in U.S. Pat. No. 4,054,205 to Blow, Jr. et al, which shows a spout that is attached to the can top that can be rotated to alternatively expose or reseal the can lid opening. A major disadvantage related to this type of can opening design is the requirement that the pull-tab must be completely removed from the can. The separated pull-tab has caused many environmental problems. Specifically, littered pull-tabs have contributed to the world-wide pollution problem. Additionally, these littered pull-tabs present a threat to wildlife. The sharp edged pull-tabs can be ingested by animals thereby causing internal injury. The environmental concerns regarding pull-tab type can openers have resulted in the further modification of can openers. Among various new designs is the push-tab type. According to this type of design, a tab is pivotally attached to the lid adjacent to an impressed rill. An opening is made in the lid by pivoting the tab which exerts a force on the portion of the lid that is bounded by the impressed rill, thus tearing away that portion. The push-tab remains attached to the can lid.

The art lacks an acceptable beverage can drinking attachment which can be mounted on such a push-tab type can. Also lacking is a beverage can drinking attachment which can achieve a liquid tight connection with a beverage can having a tab that remains attached to the can lid after opening.

SUMMARY OF THE INVENTION

It is therefore an object of the present invention to provide a beverage can attachment usable with an environmentally desirable can.

It is a further object of the invention to provide a beverage can attachment that can fit over a beverage can which has a lid opening device that remains attached to the can after opening.

It is still another object of the present invention to provide a beverage can attachment which can attach to a wide variety of beverage cans.

It is yet another object of this invention to provide a beverage can attachment which can achieve a liquid tight connection with the can top.

It is still a further object of the present invention to provide a stackable beverage can drinking attachment.

It is yet a further object of the invention to provide a beverage can attachment which has means for receiving a can lid opening device.

Yet another object of the present invention is to provide a beverage can attachment which has means for engaging an upper rim of a can.

In accordance with one aspect of the present invention these objects are achieved by a beverage can drinking attachment which includes a substantially cylindrical body having at a lower end clamping means for obtaining a liquid tight connection between the beverage can attachment and a can top; a disk extending substantially transverse across the cylindrical body, the disk having means for engaging an upper rim of the can; an aperture in the disk which when the can attachment is placed on the can top the aperture is alignable with a can lid opening; and means located in the disk for receiving a can lid opening device, the can lid opening device remaining attached to the can top after the can is opened.

BRIEF DESCRIPTION OF DRAWINGS

Other objects, features and advantages of the present invention will become apparent from the following detailed description and accompanying drawings wherein:

FIG. 1 is a perspective view of the present invention mounted on a beverage can;

FIG. 2 is a top plan view of the present invention mounted on a beverage can;

FIG. 3 is a top plan view of a beverage can drinking attachment;

FIG. 4 is a bottom plan view of the beverage can drinking attachment of FIG. 3;

FIG. 8 is a top plan view of a further embodiment of the present invention mounted on a beverage can;

FIG. 9 is a cross-sectional view taken along the line 9—9 of FIG. 8; and FIG. 10 is a fragmentary cross-sectional view taken along the line 10—10 of FIG. 9.

DETAILED DESCRIPTION OF THE PREFERRED EMBODIMENTS

Figure 5:
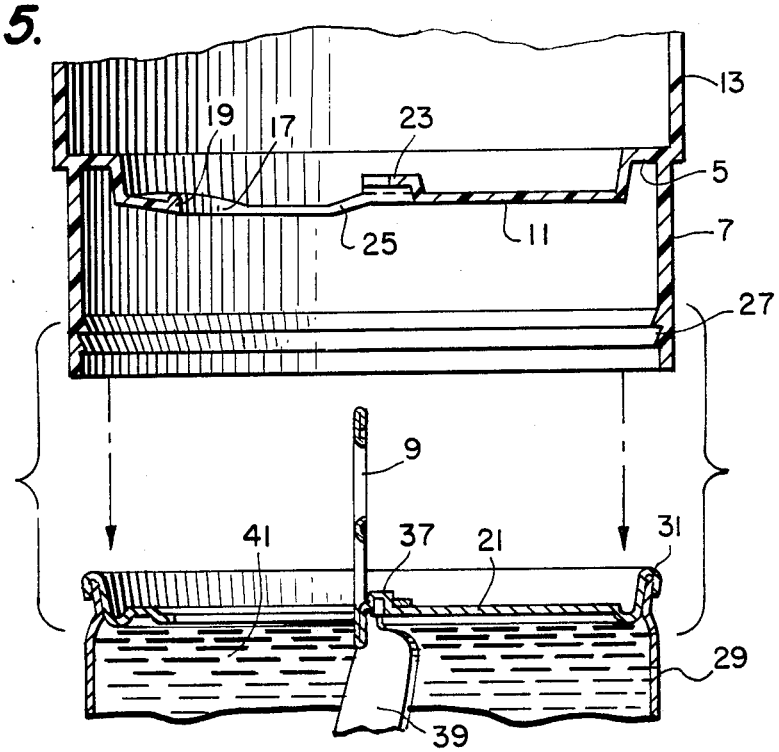
FIG. 5 is a cross-sectional view taken along the line 5—5 of FIG. 3.

Referring to FIG. 1, there is shown a beverage can attachment 1 which is mounted to a beverage can 3. An annular channel 5 encompasses the upper rim of the can. A skirt 7 extends substantially below the rim of the can. The beverage can attachment 1 can be mounted to a variety of different types of beverage cans. Preferably, the beverage cans are of the type which have a press-in or other opening device which remains attached to the can after opening.

Referring to FIGS. 2 through 4, the beverage can attachment 1 is shown mounted to the beverage can 3 having a can lid tab 9. A disk 11 has on the outer periphery the annular channel 5. The disk 11 extends substantially transverse across a cylindrical body wall 13 of the beverage can attachment 1. A disk aperture 15 is provided between the center and the rim of the disk 11 and is bounded by a protruding edge 17 of the disk 11. The protruding edge 17 slants downward toward the can, and has, on that portion nearest to the cylindrical body wall 13, a raised lip portion 19 which extends upward. The raised lip portion 19 prevents droplets which form on the protruding edge 17 from entering between the disk 11 and a can lid 21, shown in FIG. 6. A raised section 23 is centrally located on the disk 11 and has a partially cut-out section that accepts the portion of the can lid opening device which connects the can lid tab 9 to the can lid 21. Between the raised section 23 and the disk aperture 15 is a slot 25. The slot 25 is integral with the disk aperture 15 and accepts the can lid tab 9.

Figure 6:
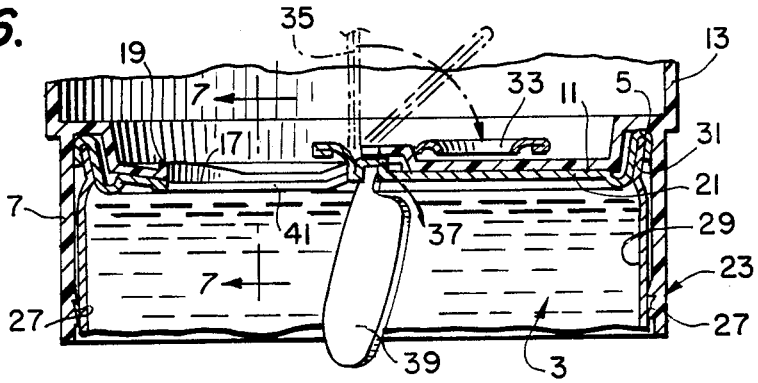
FIG. 6 is a cross-sectional view of the present invention mounted on a can.
Figure 7:
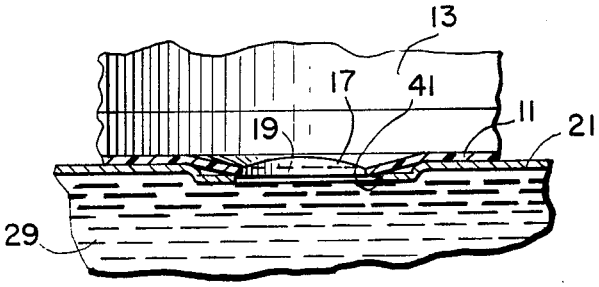
FIG. 7 is a fragmentary cross-sectional view taken along the line 7—7 of FIG. 6.

Referring to FIGS. 5 through 7, the beverage can attachment 1 is seen placed on the beverage can 3. The skirt 7 is provided at a lower edge with at least a pair of inwardly extending ribs 27. The ribs 27 engage a cylindrical can wall 29 thus providing a liquid tight connection between the beverage can attachment 1 and the beverage can 3. As shown in FIG. 6, when mounted, the skirt 7 extends substantially below an upper can rim 31. The annular channel 5 which extends along the periphery of the disk 11 encompasses the upper can rim 31. The annular channel 5 prevents the upper can rim 31 from contact the disk 11. This enables the disk 11 to contact the can lid 21 in the desired manner.

Referring to FIG. 6, the can lid tab 9 is shown in various positions. Initially, the can lid tab 9 is in a pre-open position 33. The consumer opens the can lid by moving the can lid tab 9 upward to a post-open position 35. The can lid tab 9 pivots about a tab base 37 and forces a torn away lid section 39 downward into the can, thus creating a can lid opening 41. As shown in FIG. 5, the can lid tab 9 is in the post-open position 35 when the beverage can attachment 1 is mounted on the beverage can 3. The slot 25 receives the can lid tab 9 and the raised section 23 receives the tab base 37, simultaneously. The can lid tab 9 can then be returned from the post-open position 35 to the pre-open position 33.

As shown in FIGS. 5 and 6, the upper surface of a can lid 21 is not entirely flat. Therefore the lower surface of the disk 11 does not contact the entire upper surface of the can lid 21. The protruding edge 17 prevents liquid from entering the space between the disk 11 and the can lid 21. As shown in FIG. 7, the protruding edge 17 is slanted and extends downward to contact the can lid 21 at the boundary of the can lid opening 41. Liquid is thereby prevented from entering the space between the can lid 21 and the disk 11 when the disk aperture 15 is aligned with the can lid opening 41.

Referring to FIGS. 8 through 10, there is shown further embodiments of the beverage can attachment 1. The raised section 23 and the slot 25 of the disk 11 can be modified to provide a hood 43 for receiving the can lid opening device. The hood 43 is formed substantially integral with the disk 11. As shown in FIG. 9, the can lid tab 9 is returned to the pre-open position after the can lid opening 41 is made. The beverage can attachment 1 is then mounted on the beverage can 3 in the same manner as described above. Other aspects of the hooded beverage can cap are essentially the same as the slotted beverage can cap described above.

The inner diameter of the upper end of the cylindrical body is larger than the outer diameter of the can. The beverage can attachment can therefore fit upside down over the can to conserve space during packaging and shipping.

Additionally, a plurality of attachment devices can be stackable upon each other. The skirt portion of one attachment can fit within the upper cylindrical portion of a second. In this manner a plurality of beverage can attachments can be stacked in a telescoping arrangement.

While several embodiments of the invention have been described, it will be understood that it is capable of still further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A beverage can drinking attachment comprising:

(a) a substantially cylindrical body having clamping means for obtaining a liquid tight connection between the beverage can attachment and a can top positioned at a lower end of said body;

(b) a disk extending substantially transverse across said body dividing said body into a drinking portion and a clamping portion, said disk having means for engaging the can top;

(c) an aperture in said disk which when said can attachment is placed on the can top said aperture is alignable with a can lid opening; and (d) means located on said disk for receiving a can lid opening device, the can lid opening device remaining attached to the can top after the can is opened; said receiving means comprising a raised section for accepting the can lid opening device bent into a generally flat position when the can lid opening device is in a post-open position.

2. The beverage can attachment as claimed in claim 1, wherein said can lid opening device receiving means comprises a hood formed substantially integral with said disk, said hood receiving the can lid opening device when the can lid opening device is in a pre-open position.

3. The beverage can attachment as claimed in claim 1, wherein said can lid opening device receiving means comprises a partially cut-out raised section and a slot, said can lid opening device receiving means accepting the can lid opening device when the can lid opening device is in a post-open position.

4. The beverage can attachment as claimed in claim 3, wherein said can lid opening device receiving means accepts the can lid opening device when the can lid opening device is returned from the post-open position to a pre-open position.

5. The beverage can attachment as claimed in claim 3, wherein said partially cut-out raised section is centrally located on said disk and accepts the portion of the can lid opening device that is connected to the can lid.

6. The beverage can attachment as claimed in claim 3, wherein said slot is integral with said disk aperture, said slot being centrally located on said disk, said slot accepting a tab of the can lid opening device when the can lid opening device is in the post-open position.

7. The beverage attachment as claimed in claim 1, wherein said clamping means comprises a skirt extending from a joint between said cylindrical body and said disk, said skirt having at a lower edge at least one inwardly extending rib which engages the cylindrical wall of the can, said skirt extending substantially below the rim of the can when said can attachment is placed on the can top.

8. The beverage attachment as claimed in claim 7, including a pair of ribs.

9. The beverage can attachment as claimed in claim 1, wherein said upper cam rim engaging means comprises an annular channel which extends along the periphery of said disk, said annular channel encompassing the upper rim of the can.

10. The beverage can attachment as claimed in claim 1, wherein said cylindrical body has an upper end inner diameter that is larger than the outer diameter of a beverage can, whereby said cam attachment can fit upside down over the beverage can top.

11. The beverage can attachment as claimed in claim 1, wherein said cylindrical body has an upper end inner diameter that is larger than the lower end outer diameter, whereby a plurality of said can attachments are stackable upon each other.

12. The beverage can attachment as claimed in claim 1, wherein said disk has a protruding edge extending substantially along the circumference of said disk aperture.

13. The beverage can attachment as claimed in claim 12, wherein said disk protruding edge slants downward towards said disk aperture.

14. The beverage can attachment as claimed in claim 12, wherein said disk protruding edge has an upward extending raised lip portion on that portion of said protruding edge nearest to a wall of said cylindrical body.

15. A beverage can drinking attachment comprising:

(a) a substantially cylindrical body having clamping means for obtaining a liquid tight connection between the beverage can attachment and a can top positioned at a lower end of said body;

(b) a disk extending substantially transverse across said body dividing said body into a drinking portion and clamping portion, said disk having means for engaging the can top;

(c) an aperture in said disk which when the can attachment is placed on the can top said aperture is alignable with a can lid opening;

(d) said clamping means comprising a straight, cylindrical skirt extending from a joint between said cylindrical body and said disk, said skirt having at a lower edge a pair of inwardly extending ribs which engage a cylindrical wall of the can substantially below an upper rim of the can, said skirt extending a substantial distance below the rim of the can when the can attachment is placed on the can top whereby the can attachment provides a substantially liquid tight engagement, regardless of the shape or diameter of the upper part of the can or upper rim of the can.

16. The attachment of claim 15, wherein a lower surface of said disk includes a raised angular portion around the periphery thereof and connected to said body portion.

17. The attachment of claim 15 wherein said disk includes a raised center portion.

18. The attachment of claim 15 including a slanted portion substantially surrounding said aperture for engagement at or near the can lid opening to prevent droplets from being sucked between said disk and the can lid.

19. The attachment of claim 18 wherein said aperture includes a resilient ring therein.

20. The attachment of claim 15 wherein the drinking portion has a diameter larger than the clamping portion.

21. The attachment of claim 20 wherein the diameter of the drinking portion is substantially larger than the can diameter whereby the attachment can fit upside down over the can.

22. The attachment of claim 20 wherein a plurality of attachments are nested.

23. The attachment of claim 15 wherein said clamping portion is greater than one-third the depth of said drinking portion.

24. The attachment of claim 15 wherein said clamping portion is greater than one-half the depth of said drinking portion.

* * * * *